US006325891B1

(12) United States Patent
Bergqvist et al.

(10) Patent No.: US 6,325,891 B1
(45) Date of Patent: Dec. 4, 2001

(54) METHOD OF BLEACHING PULP WITHOUT USING CHLORINE CHEMICALS IN A (QP)Z BLEACHING SEQUENCE

(75) Inventors: Anders Bergqvist; Lars Ove Larsson, both of Karlstad; Erik Nilsson, Väse; Petter Tibbling, Vålberg, all of (SE)

(73) Assignee: Kvaerner Pulping Technologies AB, Karlstad (SE)

( * ) Notice: Subject to any disclaimer, the term of this patent is extended or adjusted under 35 U.S.C. 154(b) by 917 days.

(21) Appl. No.: 08/553,324

(22) PCT Filed: May 18, 1994

(86) PCT No.: PCT/SE94/00462

§ 371 Date: Nov. 20, 1995

§ 102(e) Date: Nov. 20, 1995

(87) PCT Pub. No.: WO94/29512

PCT Pub. Date: Dec. 22, 1994

(30) Foreign Application Priority Data

Jun. 8, 1993 (SE) ..... 9301984

(51) Int. Cl.[7] ..... D21C 9/153; D21C 9/16
(52) U.S. Cl. ..... 162/65; 162/72; 162/78
(58) Field of Search ..... 162/65, 78, 76

(56) References Cited

U.S. PATENT DOCUMENTS 5,310,458 * 5/1994 Lundgren et al. ..... 162/76
5,401,362 * 3/1995 Lindberg ..... 162/65
5,415,734 * 5/1995 Backlund et al. ..... 162/65

* cited by examiner

*Primary Examiner*—Steve Alvo
(74) *Attorney, Agent, or Firm*—Jeffrey S. Melcher; Manelli Denison & Selter, PLLC

(57) ABSTRACT

Provided is a method of treating chemical paper pulp having the steps of:

adjusting the pH of the pulp to be between 1 and 6;

treating the pulp with ozone to reduce the kappa number of the pulp;

treating the pulp with a chelating agent after the ozone treating step without any intervening washing step between the ozone treating step and the chelating agent treating step;

adjusting the pH of the pulp by adding alkali together with or after the addition of chelating agent to a pH exceeding 3;

washing the pulp; and bleaching the pulp with peroxide.

25 Claims, No Drawings

METHOD OF BLEACHING PULP WITHOUT USING CHLORINE CHEMICALS IN A (QP)Z BLEACHING SEQUENCE

BACKGROUND OF THE INVENTION

The environmental protection authorities are placing ever more stringent demands on the pulp industry to decrease the use of chlorine gas in bleaching. Permitted discharges of organic chlorine compounds (AOX) together with the effluent water from the bleaching plant have gradually been lowered and are now at such a low level that pulp mills have in many cases stopped using chlorine gas. Instead, chlorine dioxide is used as the sole bleaching agent. For the same bleaching effect, chlorine dioxide forms lower quantities of AOX than does chlorine gas. However, the use of chlorine dioxide has also been called into question. On the one hand, the environmental protection authorities in certain countries demand that the discharges of organic chlorine compounds should be reduced to such a low level that it is scarcely possible to meet the requirements even when using only chlorine dioxide for bleaching. On the other hand, environmental movements in several countries, especially in Germany, have persuaded consumers to demand paper products which have been bleached entirely without using either chlorine gas or chlorine dioxide.

The pulp industry is therefore searching for methods which permit bleaching of pulp without using these chemicals. One such method has been developed by the Swedish company Eka, which supplies bleaching chemicals to the pulp industry. The bleaching method, which is termed LIGNOX (see SE-A-8902058), involves the unbleached pulp first being delignified with oxygen and then, after washing, being treated with EDTA or another suitable chelating agent in order to remove heavy metals bound within the pulp. After the EDTA stage (Q), there follows an intensive peroxide bleaching stage (P), i.e. hydrogen peroxide. The charge of hydrogen peroxide ($H_2O_2$) is relatively high, being 15–35 kg per ton of pulp, depending on the required brightness and on the bleachability of the pulp. The time is quite long, being 4 hours or more, and the temperature high, being 80–90° C.

However, the lignox method only provides a limited increase in brightness. The maximum brightness obtainable depends on the bleachability of the pulp and on the charge of peroxide. Brightnesses in the range of from 80–82 ISO have been recorded. Further bleaching stages over and above the peroxide stage are required in order to achieve higher degrees of brightness.

In this connection, ozone is a bleaching chemical of interest. Several experiments have shown that the use of an ozone bleaching stage (Z) results in the lignin content being decreased, i.e. in the kappa number being reduced. This is important, since a pulp bleached only with peroxide or oxygen/peroxide still contains a relatively high content of lignin, which affects the colour reversion tendencies of the pulp. On being heated or irradiated with sunlight, the pulp yellows. Further lignin is removed by ozone treatment, resulting in the brightness of the pulp becoming more stable.

Eka has shown that oxygen-bleached sulphate pulp which has been treated with EDTA in order to remove heavy metals and subsequently bleached with peroxide and ozone, in accordance with the sequence QPZ, yields brightnesses in the range from 82–87 ISO, depending on pulp type. By extending the bleaching sequence with an additional peroxide stage, and bleaching in accordance with the sequence QPZP, brightnesses in the range from 87–89 ISO can be achieved, depending on pulp type, see "Non Chlorine Bleaching", J. Basta, L. Andersson, W. Hermansson; Proceedings Mar. 2–5, 1992—Westin Resort—Hilton Head—South Carolina; Copyright by Miller Freeman Inc.

In another patent application, SE9101300 (SE-B-468355), Eka has described an additional bleaching method in which chelating agents are used prior to an ozone or peroxide stage. This application principally relates to ozone being used directly after a chelating-agent stage.

A prerequisite for achieving high degrees of brightness while consuming only moderate quantities of bleaching agent is that the pulp, prior to bleaching, should have been delignified to a low kappa number, preferably to a kappa number lower than 16. Normally, there is a deterioration in quality, above all a loss of fibre strength, if delignification in the digester house, and oxygen delignification, are taken too far. Nevertheless, in order to achieve a brightness of from 85–90% ISO, as required by the market, and acceptable strength, it is a prerequisite, in order to be able to carry out a chlorine-free bleaching process, that the pulp be produced by a disclosure process which yields a low kappa number, less than 20 and preferably less than 15, and a viscosity of at least about 1000 $dm^3$/kg. This process should preferably contain an oxygen-delignification stage. However, using the modified cooking methods which have been developed in recent years, it has proved possible to achieve very low kappa numbers without any loss of strength. For example, it is possible, using a modification of Kamyr's continuous cooking process MCC (modified continuous cooking) combined with MC-oxygen-delignification, to get down to, and even below, kappa numbers of 10 for soft wood and 8 for hard wood, with strength properties being retained; if use is additionally made of Kamyr's patented ITC (IsoThermal Cooking) process, even lower kappa numbers can be obtained, with kappa numbers of less than 15 after the digester easily being achieved, which, in the case of soft wood, provides kappa numbers of less than 10 after oxygen delignification.

The modification in accordance with the ITC or MCC process involves the Hi-heat washing zone in the lower part of the continuous digester also being utilized for countercurrent cooking (see EP-A-476230). This is brought about by heating to full cooking temperature in the Hi-heat circulation and by adding alkaline cooking liquid to this same circulation. The total cooking time in countercurrent is thereby extended to 3–4 hours as against about 1 hour in the case of conventional MCC. This results in a very low concentration of lignin being obtained at the end of the cooking, in turn providing improved selectivity in the delignification, i.e. the lignin in the wood is released efficiently without the cellulose being attacked to any appreciable extent. By these means, the cooking and oxygen delignification can be carried out down to very low kappa numbers without impairing the properties of the pulp, thereby ensuring that bleaching with chemicals of the peroxide, etc., type can be used for bleaching up to full brightness with the properties of the pulp at the same time remaining acceptable.

As is evident from the publications cited above, known technique indicates that a Q stage, i.e. a chelating agent, should always be used prior to a Z or a P stage, preferably with an intermediate wash.

SUMMARY OF THE INVENTION

The object of the present invention is to bring about a method of bleaching pulp without using chlorine-containing agents, with the use of ozone and peroxide, these latter chemicals being used as efficiently as possible with a view to achieving a finally bleached pulp having a brightness as required by the market.

DETAILED DESCRIPTION OF PREFERRED EMBODIMENTS

Somewhat surprisingly, in experiments carried out at Kamyr, it has been possible to establish, contrary to that which has been indicated above, that improved bleaching results are obtained if no chelating agent is used when the bleaching sequence is initiated with an ozone stage. Over and above this, it has also been possible to establish, thereby further reinforcing the surprising effect, that when, in conformity with the invention, the ozone stage is followed by a peroxide stage, it is better not to carry out a wash after the ozone stage before adding the chelating agent. Thus, a very good effect has been observed at Kamyr when an ozonization is initially carried out (without adding chelating agent), and this is then succeeded directly by the addition of chelating agent, after which there follows a wash before bleaching is carried out using peroxide.

In addition to this, it has been found, altogether surprisingly, that it is of great importance when the pH adjustment is carried out in relation to the addition of chelating agent. In this connection, it has been found to be completely inappropriate to make the pH adjustment before adding chelating agent. By far the best result is obtained when the chelating agent and alkali are added simultaneously. Good results are also obtained when the alkali charge is added after adding the chelating agent. It is most preferable for the simultaneous addition to be carried out in a mixer.

It has been possible to establish that perfectly satisfactory brightness, i.e. reaching 85–90% ISO, can be obtained when the pulp is bleached in an acid (pH adjusted to the region of from 2–6, preferably to about 3) stage with ozone, after which the pulp is treated directly with chelating agent, and is pH-adjusted (addition of alkali), without any preceding wash. The pH adjustment can be carried out prior to, at the same time as, or after, the addition of the chelating agent. The pulp is subsequently washed in at least one stage, where appropriate several stages, so that a very good degree of washing efficiency (at least 80%, preferably 90%, and even more preferably greater than 95%) is achieved. This procedure results in a significantly improved reduction in substances, such as, for example, principally manganese, which are harmful for the subsequent peroxide bleaching. After the wash, the pH of the pulp is adjusted to that level which is most favourable for the subsequent peroxide bleaching. The pH is then within the range of from 8–13, most frequently of from 10–12. In connection with the abovementioned treatment, the pulp can also be treated with an alkaline earth metal, such as, for example, Mg or Ca (salts thereof). The peroxide is added directly after this treatment. The pulp is washed after the peroxide treatment.

The method according to the invention results in the peroxide stage having a significantly improved effect as compared with previously known methods (Lignox, QPZ, QPZP, etc.).

EXAMPLE 1

Experiments were carried out on oxygen-delignified sulphate pulp of soft wood which was washed. The pulp had a kappa number of 15.7 and a viscosity of 990 $dm^3$/kg. The pulp contained 48 g/BDMT Mn. Some of the pulp was treated in accordance with a previously known procedure using chelating agent prior to the ozone stage, and some in accordance with the invention, where chelating agent was added directly after the acid ozone stage. After that, the pulp was peroxide-bleached in a similar manner in both cases. Q indicates treatment with chelating agent. Method 1 describes a known procedure, method 2 describes the procedure according to the invention.

Experiments

| | Method 1 | Method 2 |
|---|---|---|
| Original pulp | | |
| Kappa number | 15.7 | 15.7 |
| Viscosity, $dm^3$/kg | 990 | 990 |
| Loss on washing kgCOD/-BDMT | 5 | 5 |
| Mg g/BDMT | 356 | 356 |
| Mn g/BDMT | 48 | 48 |
| Stage 1 pretreatment | | |
| Consistency % | 10 | 10 |
| Temp. ° C. | 50 | 50 |
| Time, min. | 60 | 60 |
| pH | 5.8 | 4.5 |
| Charge of EDTA kg/BDMT | 2 | 0 |
| Ozonization | | |
| Consistency % | 10 | 10 |
| pH | 3 | 3 |
| Charge of $H_2SO_4$ kg/BDMT | 5 | 5 |
| Charge of $O_3$ kg/BDMT | 6 | 6 |
| Temp. ° C. | | |
| After-treatment | | |
| Consistency % | 10 | 10 |
| Temp. ° C. | 50 | 50 |
| Time, min. | 25 | 25 |
| Charge of NaOH kg/BDMT | 15 | 7 |
| Charge of EDTA kg/BDMT | 0 | 2 |
| Pulp after stage 1 | | |
| Kappa number | 8.2 | 8.2 |
| Viscosity $dm^3$/kg | 813 | 802 |
| Mg g/BDMT | 152 | 101 |
| Mn g/BDMT | 24 | 0.6 |
| Stage 2 Peroxide treatment | | |
| Consistency | 10 | 10 |
| Temp. ° C. | 85 | 85 |
| Charge of $MgSO_4$ kg/BDMT | 3 | 3 |
| Time, min. | 240 | 240 |
| Charge of $H_2O_2$ kg/BDMT | 35 | 35 |
| Final pH | 10.9 | 10.7 |
| Pulp after stage 2 | | |
| Kappa number | 4.2 | 2.7 |
| Brightness % ISO | 71 | 85 |
| Viscosity | 695 | 703 |

EXAMPLE 2

Oxygen-bleached soft wood pulp was acidified to pH 3. After that, it was divided into three parts. EDTA was added first to part one, followed by NaOH 10 minutes later. Both chemicals were added simultaneously to part two, and NaOH was added first to part three, followed by EDTA 10 minutes later. After the treatment, the pulps were washed. The pulp consistency was about 10%.

| Results | Contents (ppm) | | | |
|---|---|---|---|---|
| | Mg | Mn | Cu | Fe |
| Original pulp | 290 | 47 | 1.4 | 21 |
| Alt.1 (Q NaOH) | 178 | 3.2 | 0.81 | 15 |
| Alt.2 (Q + NaOH) | 104 | 0.69 | 0.49 | 11 |
| Alt.3 (NaOH Q) | 214 | 22 | 1.1 | 16 |

The results demonstrate that substantially improved results can be achieved in the chlorine-free bleaching which has been described when use is made of the invention. The substantially lower content of Mn on entry to the P treatment, as elicited by the invention, provides a drastically improved brightness combined with good viscosity.

It will be evident to the person skilled in the art that the described procedure for peroxide bleaching can be carried out in a number of different ways, and under different conditions, and that this merely constitutes one example. (Time, temp., charge of $h_2O_2$, pH, pulp consis., etc., can be varied.) It will be evident, too, that $O_2$ can be used in conjunction with the peroxide treatment.

What is claimed is:

1. Method of treating chemical paper pulp comprising the steps of:

adjusting the pH of the pulp to be between 1 and 6 treating the pulp with ozone to reduce the kappa number of the pulp;

treating the pulp with a chelating agent after the ozone treating step without any intervening washing step between the ozone treating step and the chelating agent treating step;

adjusting the pH of the pulp by adding alkali together with or after the addition of chelating agent to a pH exceeding 3;

washing the pulp; and bleaching the pulp with peroxide.

2. Method of treating chemical paper pulp according to claim 1, wherein the pulp is pH-adjusted by adding alkali, to a pH exceeding 4.

3. The method as claimed in claim 2 wherein alkali is added to achieve a pH between 4 and 6.

4. Method of treating chemical paper pulp according to claim 1, wherein the reduction of the kappa number in the ozone stage exceeds 20%.

5. The method as claimed in claim 4 wherein the reduction of the kappa number in the ozone stage exceeds 30%.

6. The method as claimed in claim 4 wherein said reduction of the kappa number in the ozone stage exceeds 40%.

7. Method of treating chemical paper pulp according to claim 1, wherein the charge of peroxide exceeds 5 kg/BDMT.

8. The method as claimed in claim 7 wherein the charge of peroxide exceeds 8 kg/BDMT.

9. Method of treating chemical paper pulp according to claim 1, wherein the temperature in ozone treating step is between 20 and 70° C.

10. The method as claimed in claim 9 wherein the temperature in conjunction with the ozonization is between 30 and 50 C.

11. Method of treating chemical paper pulp according to claim 1, wherein the concentration of the pulp is between 5 and 25%.

12. The method as claimed in claim 11 wherein the concentration of the pulp is between 7 and 20%.

13. The method as claimed in claim 11 wherein the concentration of the pulp is between 7 and 17%.

14. Method of treating chemical paper pulp according to claim 1, wherein the pH during the ozone treating step is from 1–6.

15. The method as claimed in claim 14 wherein the ozonization takes place at a pH of from 2–4.

16. The method as claimed in claim 14 wherein the ozonization takes place at a pH of about 3.

17. Method of treating chemical paper pulp according to claim 1, wherein the content of manganese in the pulp on entry to the peroxide treating step is less than 5 g/BDMT of pulp.

18. The method as claimed in claim 17 wherein the content of manganese in the pulp on entry to the peroxide stage is less than 1 g/BDMT of pulp.

19. The method as claimed in claim 18 wherein the content of manganese in the pulp on entry to the peroxide stage is more preferably 0.5 g/BDMT.

20. Method according to claim 1, wherein said alkali is added together with said chelating agent to said pulp.

21. Method according to claim 1, wherein said ozone treatment step is an initial bleaching stage after oxygen delignification.

22. Method according to claim 1, wherein said ozone treatment step precedes all peroxide bleaching stages.

23. In a method of bleaching pulp in which the pulp is treated with a chelating agent, ozone and peroxide, the improvement comprising the steps of:

treating the pulp with ozone;

treating the pulp with a chelating agent without any intervening washing step between said ozone treating step and said chelating agent step;

and treating said pulp with peroxide.

24. Method according to claim 23, wherein said ozone treatment step is an initial bleaching stage after oxygen delignification.

25. A method according to claim 23, wherein said ozone treating step precedes all peroxide bleaching steps.

* * * * *

UNITED STATES PATENT AND TRADEMARK OFFICE

CERTIFICATE OF CORRECTION

PATENT NO. : 6,325,891 B1
DATED : December 4, 2001
INVENTOR(S) : Bergqvist et al.

It is certified that error appears in the above-identified patent and that said Letters Patent is hereby corrected as shown below:

Title page,
Insert -- [*] Notice: Under 35 U.S.C. 154(b), the term of this patent shall be extended for 0 days. --.

Signed and Sealed this

Third Day of December, 2002

JAMES E. ROGAN
*Director of the United States Patent and Trademark Office*